US007632154B1

(12) United States Patent
Su et al.

(10) Patent No.: US 7,632,154 B1
(45) Date of Patent: Dec. 15, 2009

(54) RECEPTACLE CONNECTOR

(75) Inventors: Yu Hung Su, Tu-Cheng (TW); Yao Ting Wang, Tu-Cheng (TW); Ning Lang Cheng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/219,639

(22) Filed: Jul. 25, 2008

(51) Int. Cl.
*H01R 24/00* (2006.01)

(52) U.S. Cl. ..... 439/660

(58) Field of Classification Search ..... 439/607, 439/79, 660
See application file for complete search history.

(56) References Cited

U.S. PATENT DOCUMENTS 6,007,382 A * 12/1999 Wu ..... 439/607
D432,992 S * 10/2000 Lok ..... D13/147
6,447,311 B1 * 9/2002 Hu et al. ..... 439/108
7,086,901 B2 * 8/2006 Zhang ..... 439/607
7,150,651 B1 * 12/2006 Yuan et al. ..... 439/607
7,500,876 B2 * 3/2009 Chang ..... 439/607.01
2006/0234530 A1 * 10/2006 Chung ..... 439/79
2006/0234555 A1 * 10/2006 Chung ..... 439/607

* cited by examiner

*Primary Examiner*—Briggitte R Hammond
(74) *Attorney, Agent, or Firm*—Rosenberg, Klein & Lee

(57) ABSTRACT

A receptacle connector includes a shell, an insulating body and a plurality of terminals. The shell has a base board, two side boards and two top boards engaged with each other. A receiving recess is defined by the base board, the side boards and the top boards together. Each of the top boards defines at least one fixing opening. The insulating body has a base portion and a press plate connected with a top of the base portion. The press plate defines at least two fixing portions. The base portion is received in the receiving recess, the press plate is mounted on the top boards and the fixing portions are snapped into the corresponding fixing openings. The terminals are disposed in the base portion and stretch into the receiving recess.

10 Claims, 3 Drawing Sheets

RECEPTACLE CONNECTOR

BACKGROUND OF THE INVENTION

1. Field of the Invention

The present invention relates to an electrical connector, and more particularly to a receptacle connector.

2. The Related Art

A conventional receptacle connector includes a metal shell, an insulating body and a plurality of terminals disposed in the insulating body. The insulating body is received in the metal shell. The metal shell has a base board, two side boards and two top boards. The two top boards are engaged with each other and soldered together via a laser point welding. However, under long-time use, the two top boards are apt to separate from each other resulting in the insulating body falling off the metal shell easily. Furthermore, a process of the laser point welding relatively increases a production cost of the receptacle connector.

SUMMARY OF THE INVENTION

It is an object of the present invention to provide a receptacle connector including a shell, an insulating body and a plurality of terminals. The shell has a base board, two side boards and two top boards engaged with each other. A receiving recess is defined by the base board, the side boards and the top boards together. Each of the top boards defines at least one fixing opening. The insulating body has a base portion and a press plate connected with a top of the base portion. The press plate defines at least two fixing portions. The base portion is received in the receiving recess, the press plate is mounted on the top boards and the fixing portions are snapped into the corresponding fixing openings. The terminals are disposed in the base portion and stretch into the receiving recess.

As described above, the insulating body has the press plate mounted on the top boards of the shell and the fixing portions snapped in the corresponding fixing openings to abut against the respective top boards, whereby the top boards can be engaged with each other firmly and are prevented from separating from each other.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 2:
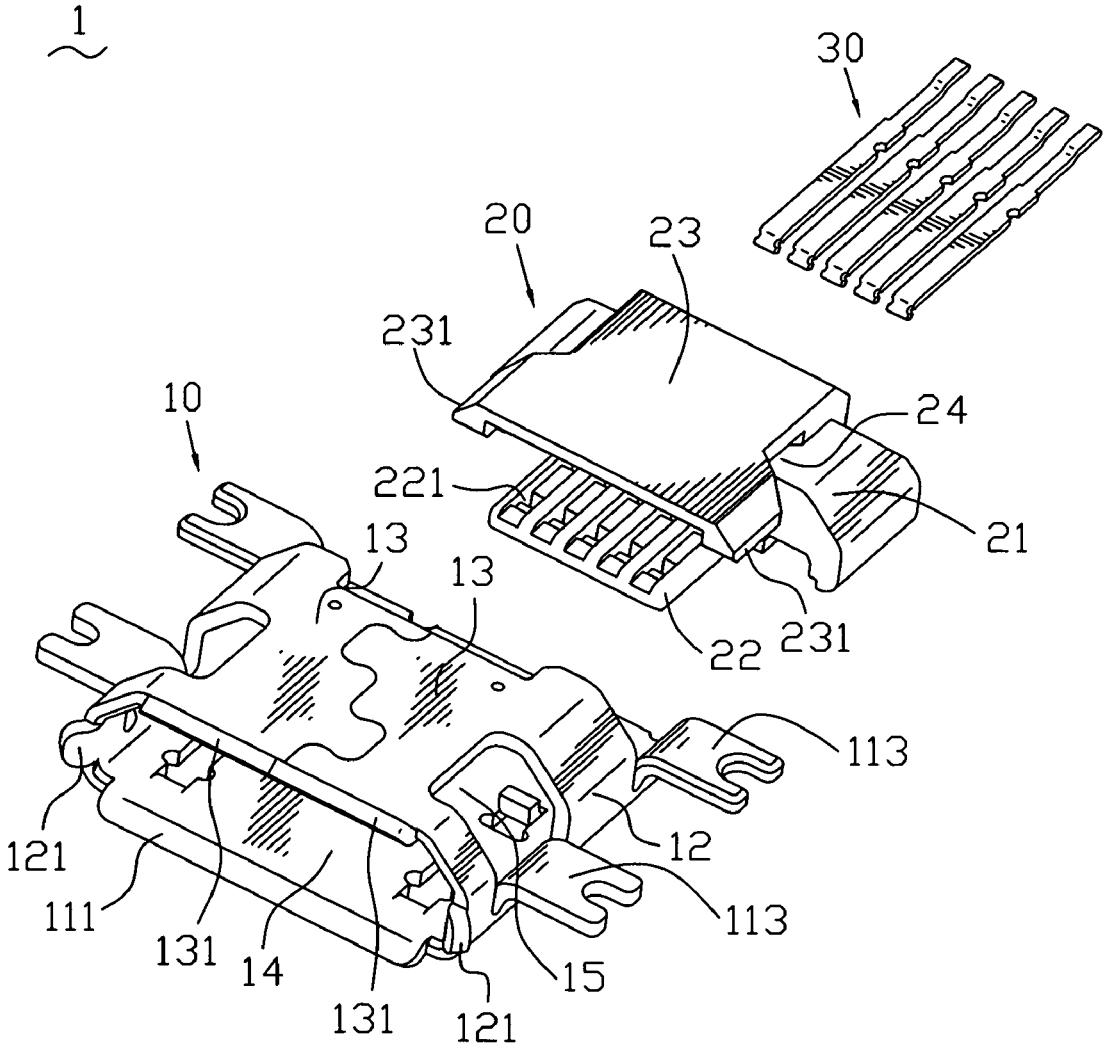
FIG. 2 is an exploded perspective view of the receptacle connector of FIG. 1.

Referring to FIG. 2, a receptacle connector 1 according to the present invention includes a metal shell 10, an insulating body 20 engaged with the metal shell 10 and a plurality of terminals 30 disposed in the insulating body 20.

Figure 3:
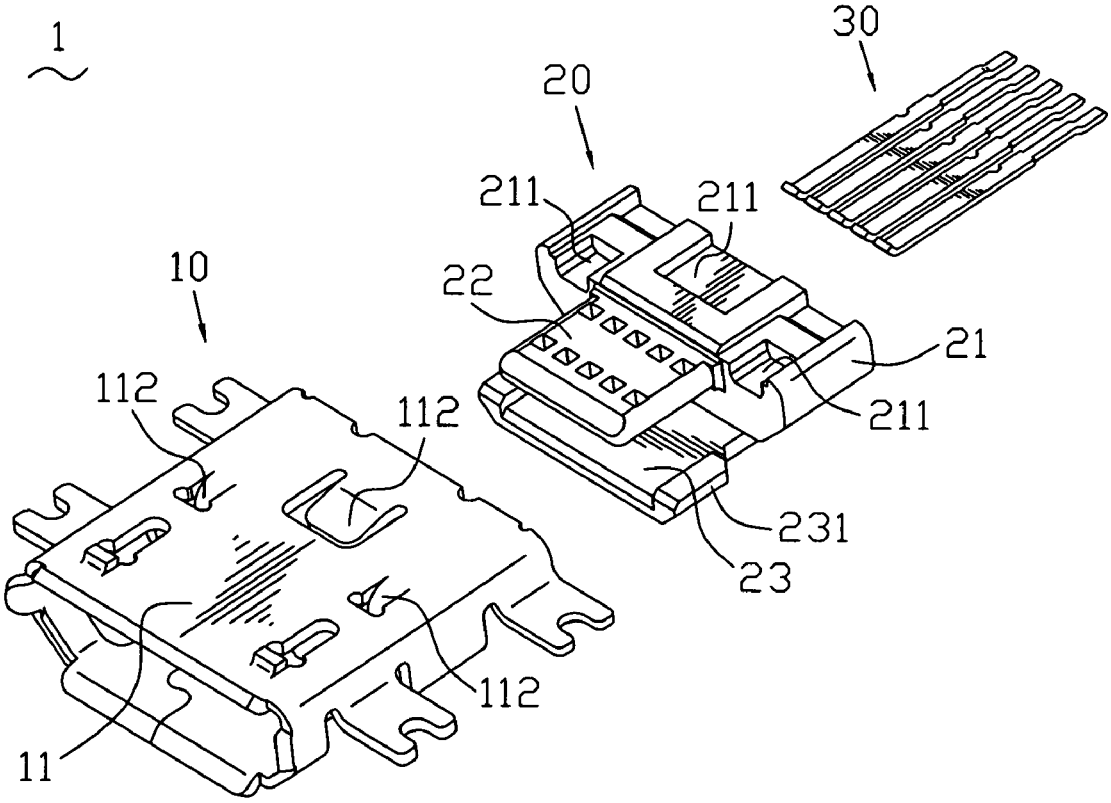
FIG. 3 is an exploded perspective view of the receptacle connector of FIG. 1 viewed from another angle.

Referring to FIG. 2 and FIG. 3, the metal shell 10 has a rectangular base board 11. Two opposite sides of the base board 11 extend upward and then are inclined toward each other to form two side boards 12 facing each other. A rear end of each of the side boards 12 is apart from a rear end of the base board 11. Two top ends of the side boards 12 horizontally extend toward each other to form a pair of top boards 13 engaged with each other. A receiving recess 14 is defined by the base board 11, the two side boards 12 and the two top boards 13. Two opposite fixing openings 15 are defined respectively in the junction areas between the top boards 13 and the corresponding side boards 12, and communicate with the receiving recess 14. A front end of the base board 11 extends forward and then is inclined downward to form a first guiding portion 111. The base board 11 has three preventing arms 112 formed thereon and each preventing arm 112 has a rear end connected with the base board 11 and a front end inclined upward freely to stretch into the receiving recess 14. The two lateral sides of the base board 11 respectively bend upward and then extend outward to form two pairs of soldering feet 113, wherein one pair of the soldering feet 113 are respectively located behind the corresponding side boards 12 and the other pair of the soldering feet 113 are respectively adjacent to a bottom of the corresponding fixing openings 15. A front end of each side board 12 extends forward and then is inclined outward to form a second guiding portion 121 at bottom. A front end of each of the top boards 13 extends forward and is inclined upward to form a third guiding portion 131.

Referring to FIG. 2 and FIG. 3 again, the insulating body 20 has a base portion 21 mated with a rear of the receiving recess 14 of the metal shell 10 and a tongue portion 22 extended forward from a middle portion of the base portion 21. A top of the tongue portion 22 defines a plurality of cavities 221 extending rearward to pass through the base portion 21. A bottom of the base portion 21 defines three locking recesses 211, each of which corresponds to the respective preventing arm 112 of the metal shell 10. A rear top portion of the base portion 21 protrudes upward and then extends forward to form a press plate 23 located over the tongue portion 22. Accordingly, a locating space 24 is formed between the press plate 23 and the base portion 21. Two opposite ends of a front portion of the press plate 23 respectively protrude oppositely and then extend downward to form a pair of fixing portions 231.

Figure 1:
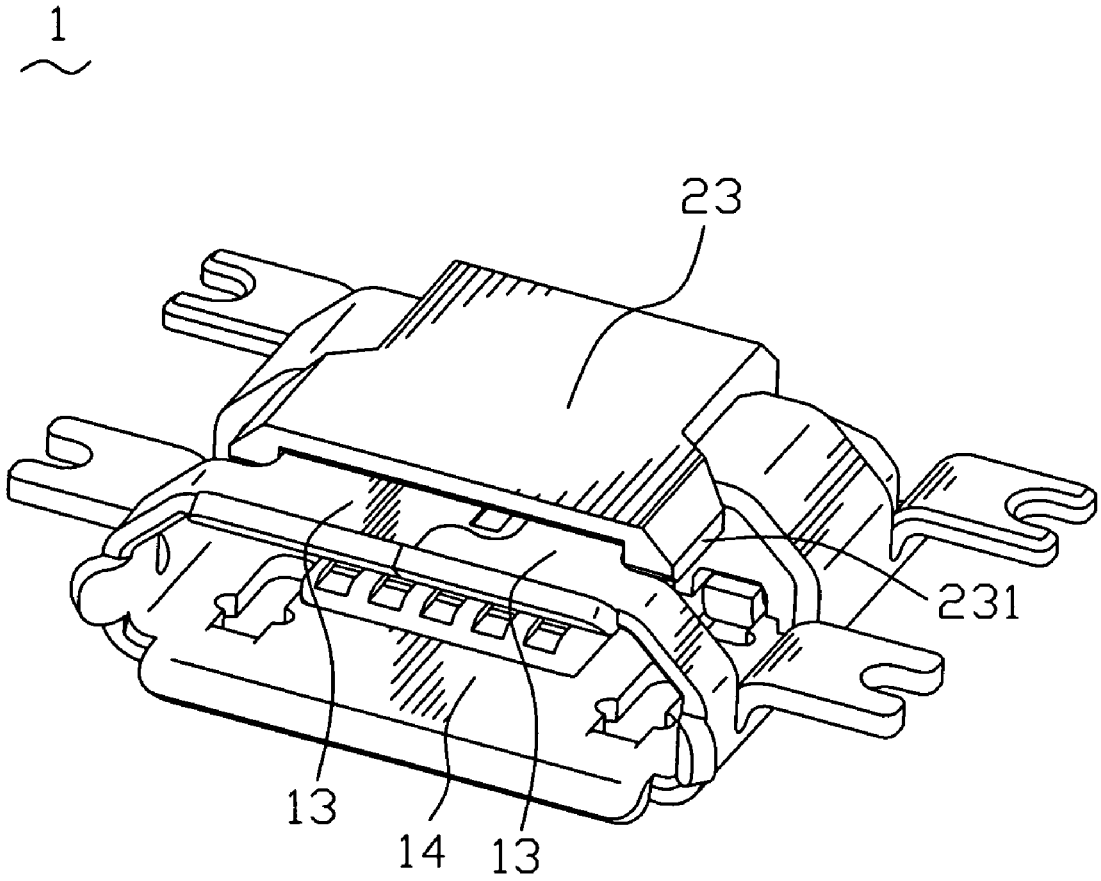
FIG. 1 is a perspective view of a receptacle connector in accordance with the present invention.

Referring to FIGS. 1-3, during assembly, the terminals 30 are disposed in the corresponding cavities 221 of the insulating body 20, and in other word, the base portion 21 and the tongue portion 22 of the insulating body 20 are inserted into the receiving recess 14 of the metal shell 10. A rear of each of the top boards 13 is inserted in the locating space 24. The press plate 23 is mounted on the top boards 13. The fixing portions 231 are snapped into the corresponding fixing openings 15 and abut against the respective top boards 13 so as to make the top boards 13 engaged with each other firmly to prevent the top boards 13 from separating from each other. The front ends of the preventing arms 112 are snapped into the corresponding locking recesses 211 for making the insulating body 20 located in the metal shell 10 firmly. The soldering feet 113 are soldered to a printed circuit board (not shown) for fixing the receptacle connector 1. The first guiding portion 111, the second guiding portions 121 and the third guiding portions 131 are used to guide a plug connector (not shown) to be inserted into the receptacle connector 1 with more ease.

As described above, the insulating body 20 has the press plate 23 mounted on the top boards 13 of the metal shell 10 and the fixing portions 231 snapped in the corresponding fixing openings 15 and abutting against the respective top boards 13, instead of a conventional process of a laser point welding, whereby the top boards 13 can be engaged with each other firmly and prevented from separating from each other under long-time use. Therefore, the insulating body 20 can be firmly disposed in the metal shell 10 so as to ensure the stability of the receptacle connector 1. Furthermore, a production cost of the receptacle connector 1 can be relatively reduced by way of omitting the process of the laser point welding.

What is claimed is:

1. A receptacle connector, comprising:

a shell having a base board, two side boards and two top boards engaged with each other, a receiving recess being defined by the base board, the two side boards and the two top boards cooperatively;

an insulating body having a base portion and a press plate connected with a top portion of the base portion, the base portion being received in the receiving recess, the press plate being mounted on and abutting against the top boards, the press plate stretches beyond a front of the base portion, and the fixing portions are defined in a front of the press plate; and a plurality of terminals disposed in the base portion and stretching into the receiving recess;

wherein each of the top boards define at least one fixing opening, and the press plate defines at least two fixing portions which are snapped into the corresponding fixing openings.

2. A receptacle connector, comprising:

a shell having a base board, two side boards and two top boards engaged with each other, a receiving recess being defined by the base board, the two side boards and the two top boards cooperatively;

an insulating body having a base portion and a press plate connected with a top portion of the base portion, the base portion being received in the receiving recess, the press plate being mounted on and abutting against the top boards, the press plate and the base portion define a locating space therebetween, and one end of each of the top boards being inserted in the locating space; and a plurality of terminals disposed in the base portion and stretching into the receiving recess.

3. The receptacle connector as claimed in claim 2, wherein the press plate extends upon the base portion upward and then forward.

4. The receptacle connector as claimed in claim 2, wherein each top board defines at least one fixing opening, and the press plate defines at least two fixing portions which are snapped into the corresponding fixing openings.

5. The receptacle connector as claimed in claim 4, wherein each of the fixing openings is defined at the junction area between the side boards and the corresponding top boards.

6. The receptacle connector as claimed in claim 4, wherein the fixing portions are formed by way of two opposite sides of the press plate protruding oppositely and then extending downward.

7. A receptacle connector, comprising:

a shell having a base board, two side boards and two top boards engaged with each other, a receiving recess being defined by the base board, the two side boards and the two top boards cooperatively, each of the top boards defining at least one fixing opening;

an insulating body having a base portion and a press plate connected with a top portion of the base portion, the press plate defining at least two fixing portions, the base portion being received in the receiving recess, the press plate being mounted on the top boards and the fixing portions being snapped into the corresponding fixing openings, the fixing portions being formed by way of two opposite sides of the press plate protruding oppositely and then extending downward; and a plurality of terminals disposed in the base portion and stretching into the receiving recess.

8. The receptacle connector as claimed in claim 7, wherein each of the fixing openings is defined at the junction area between the side boards and the corresponding top boards.

9. The receptacle connector as claimed in claim 7, wherein the press plate extends upon the base portion upward and then forward.

10. The receptacle connector as claimed in claim 7, wherein the press plate stretches beyond a front of the base portion, and the fixing portions are defined in a front of the press plate.

* * * * *